US008643302B2

(12) United States Patent
Kitamura et al.

(10) Patent No.: US 8,643,302 B2
(45) Date of Patent: Feb. 4, 2014

(54) SWITCHING POWER-SUPPLY DEVICE AND LUMINAIRE

(75) Inventors: Noriyuki Kitamura, Kanagawa-ken (JP); Yuji Takahashi, Kanagawa-ken (JP)

(73) Assignee: Toshiba Lighting & Technology Corporation, Kanagawa-Ken (JP)

( * ) Notice: Subject to any disclaimer, the term of this patent is extended or adjusted under 35 U.S.C. 154(b) by 134 days.

(21) Appl. No.: 13/424,073

(22) Filed: Mar. 19, 2012

(65) Prior Publication Data

US 2012/0248999 A1 Oct. 4, 2012

(30) Foreign Application Priority Data

Mar. 30, 2011 (JP) ..... 2011-074676
Jul. 6, 2011 (JP) ..... 2011-150085

(51) Int. Cl.
*H05B 37/00* (2006.01)
*H05B 37/02* (2006.01)
*H02M 3/335* (2006.01)

(52) U.S. Cl.
USPC ..... 315/291; 315/200 R; 315/307; 363/21.12

(58) Field of Classification Search
USPC ..... 315/200 R, 51, 291, 224, 287; 363/21.12
See application file for complete search history.

(56) References Cited

U.S. PATENT DOCUMENTS 5,644,480 A * 7/1997 Sako et al. ..... 363/17
8,258,713 B2 * 9/2012 Deppe et al. ..... 315/224
2010/0164404 A1 7/2010 Shao et al.
2010/0308733 A1 * 12/2010 Shao ..... 315/119
2012/0248999 A1 * 10/2012 Kitamura et al. ..... 315/200 R
2012/0249007 A1 * 10/2012 Kitamura et al. ..... 315/224
2013/0002160 A1 * 1/2013 Takahashi et al. ..... 315/200 R
2013/0113387 A1 * 5/2013 Kitamura et al. ..... 315/224
2013/0119860 A1 * 5/2013 Kitamura et al. ..... 315/51

FOREIGN PATENT DOCUMENTS

EP 1643810 A1 4/2006
JP 2004-119078 4/2004

OTHER PUBLICATIONS

European Search Report for European Patent Application 12160340.1 dated Jul. 26, 2012, 5 pages.

* cited by examiner

*Primary Examiner* — Daniel D Chang
(74) *Attorney, Agent, or Firm* — Patterson & Sheridan, LLP

(57) ABSTRACT

According to one embodiment, a switching power-supply device includes a switching element, a constant current element, a rectifying element, first and second inductors, and a constant voltage circuit. The switching element supplies, when the switching element is on, a power-supply voltage of a direct-current power supply to and feeds an electric current to the first inductor. The constant current element is connected to the switching element in series and turns off the switching element when the electric current of the switching element exceeds a predetermined current value. The rectifying element is connected to any one of the switching element and the constant current element in series. The second inductor is magnetically coupled to the first inductor and supplies induced potential to a control terminal of the switching element. The constant voltage circuit applies control potential to a control terminal of the constant current element.

20 Claims, 5 Drawing Sheets

SWITCHING POWER-SUPPLY DEVICE AND LUMINAIRE

CROSS-REFERENCE TO RELATED APPLICATIONS

This application is based upon and claims the benefit of priority from the prior Japanese Patent Application No. 2011-074676, filed on Mar. 30, 2011, and Japanese Patent Application No. 2011-150085, filed on Jul. 6, 2011; the entire contents of which are incorporated herein by reference.

FIELD

Embodiments described herein relate generally to a switching power-supply device and a luminaire.

BACKGROUND

In recent years, concerning illumination light sources for luminaires, more and more incandescent lamps and fluorescent tubes are replaced with light sources that consume less power and have longer life such as an LED (Light Emitting Diode). New illumination light sources such as an EL (Electro-Luminescence) and an OLED (Organic light-emitting diode) are developed. Since the luminance of these illumination light sources depends on a current value flowing thereto, when the illumination light sources are lit, a power-supply circuit that supplies a constant current is necessary. In order to adjust a direct-current power supply voltage to a rated voltage of an illumination light source, usually, step-down means is used. As step-down means having high current usage efficiency, a self-excitation DC-DC converter is proposed (see, for example, JP-A-2004-119078).

In an LED lighting device described in JP-A-2004-119078, an FET (Field-Effect Transistor), a resistor for current detection, a first inductor, and an LED circuit are connected to a direct-current power supply in series to form a loop-shape main current path. A voltage generated by resistance division of an output of the direct-current power supply is applied between a source and a gate of the FET. A voltage between both ends of the resistor for current detection is also applied between the source and the gate. A diode is connected between both ends of the first inductor and the LED circuit to form a loop-shape feedback circuit. Further, a second inductor magnetically coupled to the first inductor is provided such that an electromotive force of the second inductor is applied to the gate of the FET.

In such an LED lighting device, when a power-supply is turned on, potential generated by resistance division of a power-supply voltage is applied to the gate of the FET and the FET changes to an ON state. An electric current starts to flow to the main current path. When this electric current increases, an electromotive force is generated in the second inductor and the FET is kept on. Consequently, the LED circuit is lit and magnetic energy is accumulated in the first inductor. Thereafter, when the electric current flowing through the main current path reaches a predetermined amount, a voltage drop amount between both the ends of the resistor for current detection reaches a predetermined amount, gate potential with respect to the source potential of the FET falls to be lower than a threshold, and the FET changes to an OFF state. Consequently, the main current path is shut off. An electric current flows to the feedback circuit with the magnetic energy accumulated in the first inductor and lights the LED circuit. At this point, since this electric current decreases with time, an opposite electromotive force is generated in the second inductor and the FET is kept off. Thereafter, when the electric current decreases to zero, the direction of the electromotive force of the second inductor is reversed again and the FET changes to the ON state. According to the repetition of such operation, self-excitation DC-DC conversion is performed and a stepped-down DC voltage is supplied to the LED circuit.

However, in the LED lighting device in the past, the resistor for current detection is necessary. When the FET is on, an electric current always flows to the resistor for current detection. Therefore, a loss of electric power is large. If the resistor for current detection is not used, a heavy current is likely to flow during the start.

It is an object of the present invention to provide a switching power supply and a luminaire in which a loss of power is small and an overcurrent during the start is suppressed.

DETAILED DESCRIPTION

Figure 1:
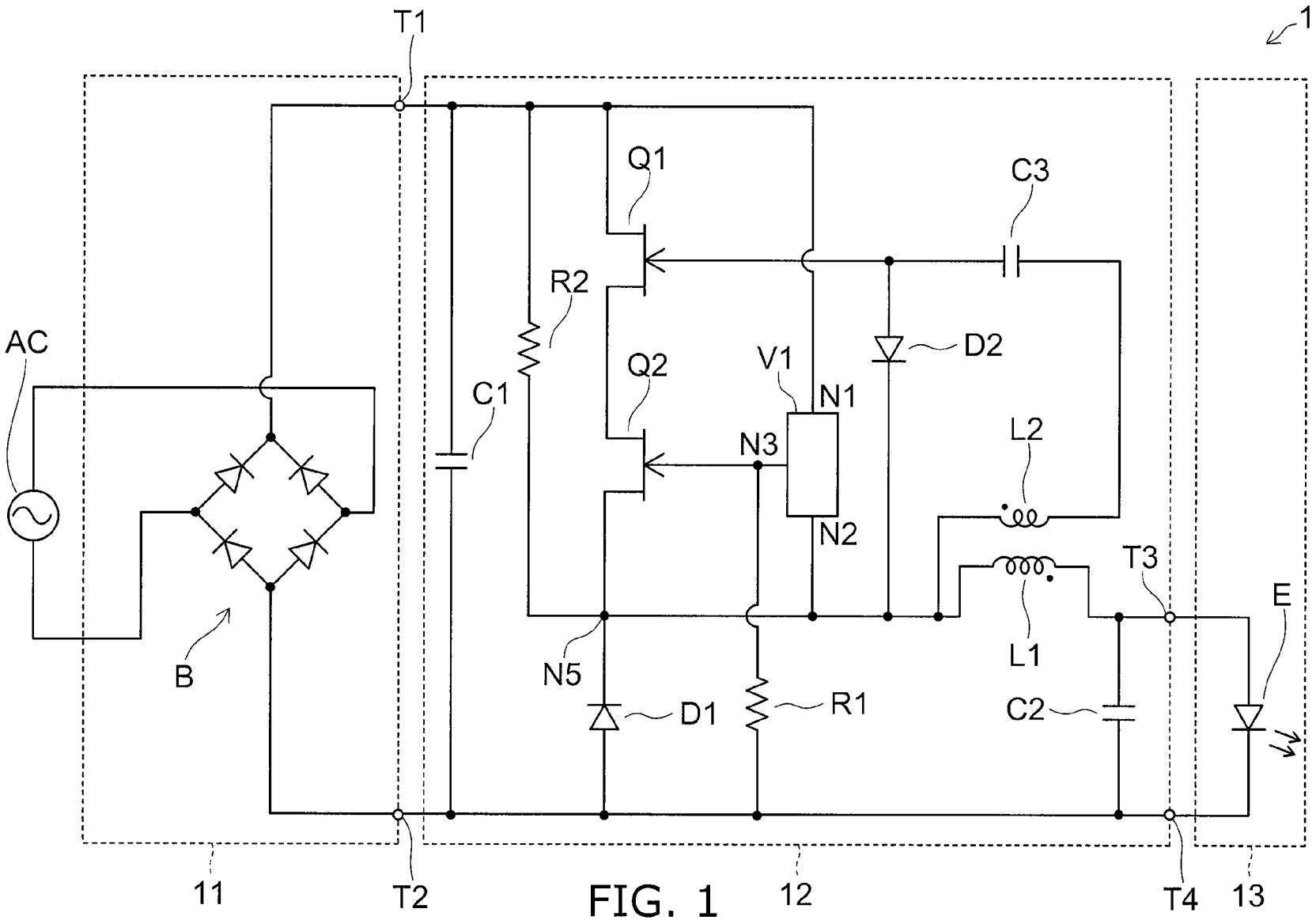
FIG. 1 is a circuit diagram of an example of a luminaire according to a first embodiment.

According to one embodiment, a switching power-supply device includes a switching element, a constant current element, a rectifying element, a first inductor, a second inductor, and a constant voltage circuit. The switching element supplies, when the switching element is on, a power-supply voltage of a direct-current power supply to and feeds an electric current to the first inductor. The constant current element is connected to the switching element in series and turns off the switching element when the electric current of the switching element exceeds a predetermined current value. The rectifying element is connected to any one of the switching element and the constant current element in series and feeds the electric current of the first inductor when the switching element is turned off. The second inductor is magnetically coupled to the first inductor and has induced therein potential for turning on the switching element when the electric current of the first inductor increases and has induced therein potential for turning off the switching element when the electric current of the first inductor decreases and supplies the induced potential to a control terminal of the switching element. The constant voltage circuit applies control potential to a control terminal of the constant current element.

According to another embodiment, a switching power-supply device includes a switching element, a constant current element, a rectifying element, a first inductor, a second inductor, and a constant voltage circuit. A first terminal of the switching element is connected to one terminal of a direct-current power supply. A first terminal of the constant current element is connected to a second terminal of the switching element. A first terminal of the first inductor is connected to a second terminal of the constant current element. The second inductor is magnetically coupled to the first inductor, supplies control potential for turning on the switching element to a control terminal of the switching element when an electric current flowing to the first inductor increases, and supplies control potential for turning off the switching element to the control terminal of the switching element when the electric current flowing to the first inductor decreases. The rectifying element is connected between the other terminal of the direct-current power supply and a first terminal of the first inductor and feeds an electric current in a direction in which an electric current in the same direction as the electric current supplied to the first inductor is supplied to the first inductor via the switching element and the rectifying element. The constant voltage circuit applies a control voltage between a second terminal and a control terminal of the constant current element.

According to still another embodiment, a luminaire includes a switching power-supply device and a lighting load connected between output terminals of the switching power-supply device. The switching power-supply device includes a switching element, a constant current element, a rectifying element, a first inductor, a second inductor, and a constant voltage circuit. The switching element supplies, when the switching element is on, a power-supply voltage of a direct-current power supply to and feeds an electric current to the first inductor. The constant current element is connected to the switching element in series and turns off the switching element when the electric current of the switching element exceeds a predetermined current value. The rectifying element is connected to any one of the switching element and the constant current element in series and feeds the electric current of the first inductor when the switching element is turned off. The second inductor is magnetically coupled to the first inductor and has induced therein potential for turning on the switching element when the electric current of the first inductor increases and has induced therein potential for turning off the switching element when the electric current of the first inductor decreases and supplies the induced potential to a control terminal of the switching element. The constant voltage circuit applies control potential to a control terminal of the constant current element.

Embodiments are explained below with reference to the drawings.

First, a first embodiment is explained.

FIG. 1 is a circuit diagram of an example of a luminaire according to this embodiment.

Figure 2:
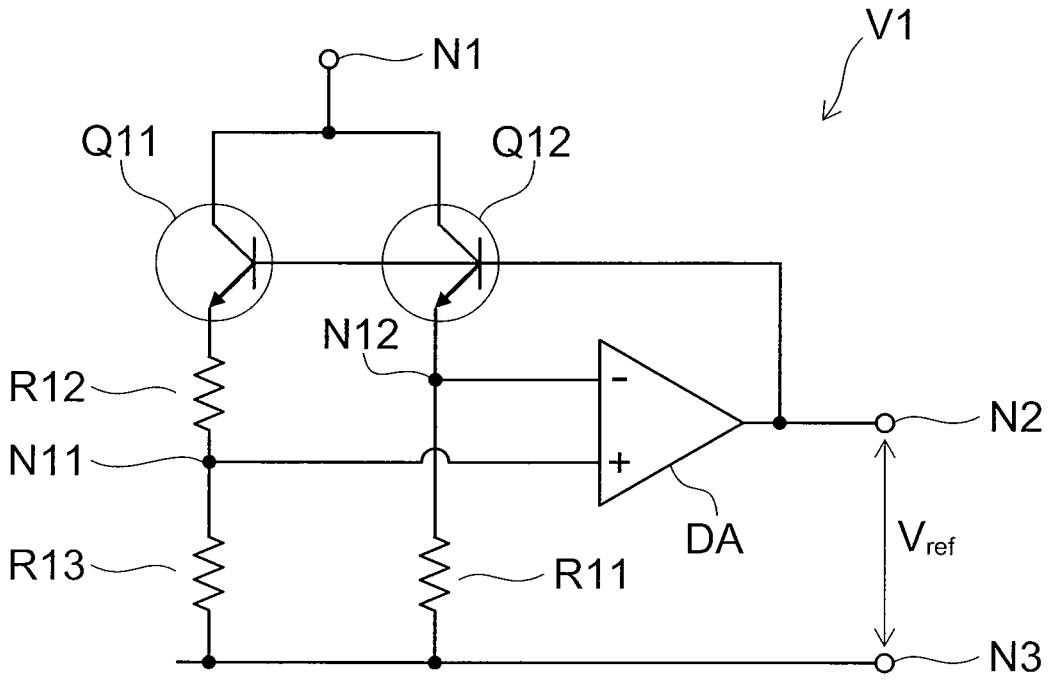
FIG. 2 is a circuit diagram of an example of a constant voltage circuit in the first embodiment.

FIG. 2 is a circuit diagram of an example of a constant voltage circuit in this embodiment.

As shown in FIG. 1, a luminaire 1 according to this embodiment is connected to a commercial alternating-current power supply AC and used. In the luminaire 1, a direct-current power supply 11 connected to the alternating-current power supply AC and configured to convert an alternating current supplied to the alternating-current power supply AC into a direct current, a DC-DC converter 12 configured to drop a direct-current voltage supplied from the direct-current power supply 11, and a lighting load 13 connected between output terminals of the DC-DC converter 12 are provided. In the lighting load 13, an illumination light source E configured to receive the supply of the direct current from the DC-DC converter 12 and emit light, for example, an LED element is provided. A switching power-supply device according to this embodiment is configured by the direct-current power supply 11 and the DC-DC converter 12.

In the direct-current power supply 11, a full-wave rectifier circuit B including a diode bridge is provided. An input terminal of the full-wave rectifier circuit B is connected to the alternating-current power supply AC. Output terminals of the full-wave rectifier circuit B are output terminals T1 and T2 of the direct-current power supply 11. The output terminal T1 is a terminal on a high-potential side and the output terminal T2 is a terminal on a low-potential side. The output terminals T1 and T2 of the direct-current power supply 11 are also input terminals of the DC-DC converter 12. "Terminal" is a concept indicating a position on a circuit diagram. A member equivalent to only the "terminal" is not always provided in an actual device.

In the DC-DC converter 12, a capacitor C1 is connected between the output terminal T1 and the output terminal T2 of the direct-current power supply 11. A switching element Q1, a constant current element Q2, and a rectifying element D1 are provided and connected in series in this order between the output terminal T1 and the output terminal T2.

The switching element Q1 and the constant current element Q2 are, for example, field effect transistors, high electron mobility transistors (HEMTs), or so-called GaN HEMTs formed on a substrate of silicon carbide (SiC). Channels of the GaN HEMTs are formed of a gallium nitride (GaN) or indium gallium nitride (InGaN). The switching element Q1 and the constant current element Q2 are elements of a normally on type. The rectifying element D1 is, for example, a Schottky barrier diode and is formed in the same manner as the switching element Q1 and the constant current element Q2.

A drain (a first terminal) of the switching element Q1 is connected to the output terminal T1. A source (a second terminal) of the switching element Q1 is connected to a drain (a first terminal) of the constant current element Q2. A source (a second terminal) of the constant current element Q2 is connected to a cathode of the rectifying element D1 via a connection point N5. An anode of the rectifying element D1 is connected to the output terminal T2.

In the DC-DC converter 12, a first inductor L1 and a smoothing capacitor C2 are provided. One terminal (a first terminal) of the first inductor L1 is connected to the connection point N5 and the other terminal of the first inductor L1 is connected to an output terminal T3 on a high-potential side of the DC-DC converter 12. The smoothing capacitor C2 is connected between the output terminal T3 and an output terminal T4 on a low-potential side of the DC-DC converter 12. The output terminal T4 is connected to the output terminal T2 on a low-potential side of the direct-current power supply 11. The potential of the output terminals T2 and T4 is, for example, ground potential.

Further, in the DC-DC converter 12, a second inductor L2, a coupling capacitor C3, and a diode D2 are provided. The second inductor L2 is connected between the connection point N5 and one terminal of the coupling capacitor C3 and is magnetically coupled to the first inductor L1. In the second inductor L2, when an electric current flowing from the connection point N5 to the output terminal T3 in the first inductor L1 increases, an electromotive force for setting the coupling capacitor C3 to potential higher than the potential at the connection point N5 is generated. When the electric current decreases, an electromotive force for setting the coupling capacitor C3 to potential lower than the potential at the connection point N5 is generated. The other terminal of the coupling capacitor C3 is connected to a gate, which is a control terminal, of the switching element Q1. An anode of the diode D2 is connected to the other terminal of the coupling capacitor C3 and a gate of the switching element Q1. A cathode of the diode D2 is connected to the connection point N5. The diode D2 clamps a voltage between the gate of the switching element Q1 and a source of the constant current element Q2 to a voltage equal to or lower than a forward voltage. The gate potential of the switching element Q1 (the control potential of the switching element) is level-shifted to a negative potential side. The switching element Q1 can be surely turned on and off.

Furthermore, in the DC-DC converter 12, a constant voltage circuit V1 and bias resistors R1 and R2 are provided. A terminal N1 of the constant voltage circuit V1 is connected to the output terminal T1. A terminal N2 of the constant voltage circuit V1 is connected to the connection point N5. A terminal N3 of the constant voltage circuit V1 is connected to a gate of the constant current element Q2 (a control terminal of the constant current element). The bias resistor R1 is connected between the terminal N3 and the output terminal T2. The bias resistor R2 is connected between the output terminal T1 and the terminal N2. The constant voltage circuit V1 is a circuit that receives the supply of high potential from the terminal N1, receives the supply of low potential from the terminal N3, and outputs intermediate potential between the high potential and the low potential from the terminal N2. A voltage between the terminal N2 and the terminal N3 is fixed. A gate-to-source voltage of the constant current element Q2 (a control voltage of the constant current element) is a negative fixed value.

An LED element is connected as the illumination light source E between the output terminal T3 and the output terminal T4 of the DC-DC converter 12. An anode of the LED element E is connected to the output terminal T3 and a cathode of the LED element E is connected to the output terminal T4. Consequently, a loop-shape current path of "the full-wave rectifier circuit B→the output terminal T1→the switching element Q1→the constant current element Q2→the connection point N5→the first inductor L1→the output terminal T3→the LED element E→the output terminal T4→the output terminal T2→the full-wave rectifier circuit B" is formed. A loop-shape regenerative current path of "the first inductor L1→the output terminal T3→the LED element E→the output terminal T4→the rectifying element D1→the connection point N5→the first inductor L1" is also formed. In this way, the constant current element Q2 is interposed between an input terminal of the DC-DC converter 12 (the output terminal T1 of the direct-current power supply 11) and the output terminal T3. The rectifying element D1 is connected such that an electric current in the same direction as the electric current supplied to the first inductor L1 flows via the switching element Q1 and the constant current element Q2.

As shown in FIG. 2, in the constant voltage circuit V1, bipolar transistors Q11 and Q12 are provided. Characteristic of the bipolar transistors Q11 and Q12 are substantially the same. In the constant voltage circuit V1, resistors R11, R12, and R13 and a differential amplifier DA are provided. Collectors of the bipolar transistors Q11 and Q12 are connected to the terminal N1. An emitter of the bipolar transistor Q11 is connected to the terminal N3 via the resistor R12 and the resistor R13. An emitter of the bipolar transistor Q12 is connected to the terminal N3 via the resistor R11. A contact point N11 of the resistor R12 and the resistor R13 is connected to an input terminal on a positive pole side of a differential amplifier DA. A contact point N12 of the emitter of the bipolar transistor Q12 and the resistor R11 is connected to an input terminal on a negative pole side of the differential amplifier DA. An output terminal of the differential amplifier DA is connected to bases of the bipolar transistors Q11 and Q12 and connected to the terminal N2.

The constant voltage circuit V1 can output, as a voltage $V_{ref}$ between the terminal N2 and the terminal N3, a voltage based on a base emitter voltage $V_{BE}$ of the bipolar transistors Q11 and Q12. Specifically, when temperature is represented as T, a Boltzmann constant is represented as k, a charge is represented as q, and resistances of the resistors R11, R12, an R13 are respectively represented as $R_{11}$, $R_{12}$, and $R_{13}$, the voltage $V_{ref}$ is calculated as indicated by Expression 1 below. A temperature coefficient of the base emitter voltage $V_{BE}$ of the bipolar transistors Q11 and Q12 has a negative value. However, if a resistance ratio is properly adjusted using a diffusion layer resistor, polysilicon, or the like, which has a positive temperature coefficient, as the resistors R11 to R13, a temperature coefficient of the voltage $V_{ref}$ can be reduced to substantially zero.

$$V_{ref} = V_{BE} + \left(\frac{R_{13}}{R_{12}}\right) \times \left(\frac{kT}{q}\right) \times \ln\left(\frac{R_{13}}{R_{11}}\right) \quad \text{Expression 1}$$

The operation of the luminaire according to this embodiment is explained.

Since the switching elements Q1 and Q2 are the elements of the normally on type, in an initial state, both the switching elements Q1 and Q2 are in an ON state.

(1) When the alternating-current power supply AC is connected to the direct-current power supply 11, an alternating current output from the alternating-current power supply AC is input to the direct-current power supply 11. In the direct-current power supply 11, the alternating current is converted into a direct current by the full-wave rectifier circuit B. The direct current is output from the output terminals T1 and T2 and input to the DC-DC converter 12. At this point, high potential is output from the output terminal T1 and low potential is output from the output terminal T2.

(2) In the DC-DC converter 12, after a high-frequency component is removed by the capacitor C1, the potential of the output terminal T1 is input to the terminal N1 of the constant voltage circuit V1, the potential of the output terminal T1 is input to the terminal N2 of the constant voltage circuit V1 via the bias resistor R2, and the potential of the output terminal T2 is input to the terminal N3 via the bias resister R1. Consequently, the constant voltage circuit V1 operates and sets the voltage $V_{ref}$ between the terminal N2 and the terminal N3 to a constant voltage specified by Expression 1 above. As a result, potential lower than the potential of the source of the constant current element Q2 is applied to the gate of the constant current element Q2. An electric current flowing between the drain and the source of the constant current element Q2 is limited by a source-to-gate voltage of the constant current element Q2.

(3) An electric current flows through a path of "the input terminal T1→the switching element Q1→the constant current element Q2→the first inductor L1". At this point, the electric current does not flow to the LED element E until a voltage applied to the LED element E reaches a forward voltage of the LED element E. Therefore, the smoothing capacitor C2 is charged. In other words, a voltage is applied between the source and the gate of the constant current element Q2 such that an absolute value of a negative voltage between the source and the gate of the constant current element Q2 is smaller than the forward voltage of the LED element E. Therefore, the electric current does not flow to the LED element E and the capacitor C2 is charged.

(4) When the capacitor C2 is charged and the voltage applied to the LED element E exceeds the forward voltage of the LED element E, an electric current flows through a path of "the input terminal T1→the switching element Q1→the constant current element Q2→first inductor L1→the LED element E→the input terminal T2). Consequently, the LED element E is lit and magnetic energy is accumulated in the first inductor L1. Since this current increases, an electromotive force for setting the coupling capacitor C3 side to high potential is generated in the second inductor L2. As a result, the gate potential of the switching element Q1 increases to be higher than the source potential of the switching element Q1 and the ON state of the switching element Q1 is maintained.

(5) When a value of an electric current flowing through the constant current element Q2 including an HEMT reaches a saturation current, according to the increase of the electric current, a voltage between the source and the drain of the constant current element Q2 suddenly rises. The saturation current of the constant current element Q2 is specified by a source-to-gate voltage given by the constant voltage circuit V1. According to the sudden rise of the voltage between the source and the drain of the constant current element Q2, the source potential of the switching element Q1 rises to be higher than the gate potential of the switching element Q1 and the switching element Q1 changes to an OFF state. As a result, the current path is shut off.

(6) Consequently, the magnetic energy accumulated in the first inductor L1 is radiated and an electric current flows through a regenerative current path of "the first inductor L1→the LED element E→the rectifying element D1→the first inductor L1). The lighting of the LED element E is maintained. Since this electric current decreases with time, an electromotive force for setting the coupling capacitor C3 side to low potential is generated in the second inductor L2. As a result, potential lower than the potential of the source of the switching element Q1 is applied to the gate of the switching element Q1 and the OFF state of the switching element Q1 is maintained.

(7) When the magnetic energy accumulated in the first inductor L1 decreases to zero, the direction of the electromotive force of the second inductor L2 is reversed again and an electromotive force for setting the coupling capacitor C3 side to high potential is generated. Consequently, potential higher than the potential of the source of the switching element Q1 is applied to the gate of the switching element Q1 and the switching element Q1 is turned on. Consequently, the switching element Q1 returns to the state of (4).

Thereafter, (4) to (7) are repeated. Consequently, on and off of the switching element Q1 are automatically repeated. A direct current subjected to voltage drop is supplied to the LED element E.

Effects of this embodiment are explained.

In this embodiment, when an electric current flowing through the constant current element Q2 reaches a saturation current, the voltage between the source and the drain of the constant current element Q2 suddenly rises to change the switching element Q1 to the OFF state. In other words, the saturation current of the constant current element Q2 controlled by the constant voltage circuit V1 is used to detect that the magnitude of the electric current reaches a predetermined value. Therefore, a loss of electric power is small compared with electric power lost when a resistor is used to detect that the magnitude of the electric current reaches the predetermined value. Since a resistor for current detection is unnecessary, it is possible to reduce the size of the LED lighting circuit.

Further, the LED element E can be dimmed and stopped by arbitrarily changing an output of the constant voltage circuit V1. Specifically, if the resistor for current detection is used to detect that the magnitude of the electric current reaches the predetermined value, the predetermined value is a fixed value. However, since the constant current element Q2 is used instead of the resistor for current detection, a predetermined current value to be detected can be arbitrarily changed. Furthermore, the constant voltage circuit V1 can be caused to operate to correct temperature characteristics of the switching element Q1 or the constant current element Q2. For example, the constant voltage circuit V1 can add a negative characteristic as a temperature characteristic.

Furthermore, in this embodiment, since the HEMT is used as the switching element Q1 and the constant current element Q2, a high-frequency operation is possible. For example, operation in a megahertz order is possible. In particular, since the GaN HEMT is used, a higher-frequency operation is possible. Since a withstand voltage is high, a chip size can be reduced.

Moreover, when the element of the normally on type is used as the constant current element Q2, if the saturation current of the constant current element Q2 is not controlled, it is likely that an excessive current flows in a period in which an electric current immediately after power-on is unstable or when the LED element E starts lighting. On the other hand, in this embodiment, the saturation current of the constant current element Q2 is controlled by the constant voltage circuit V1, after the power supply is turned on, even during a period until a power-supply voltage is stabilized and when the LED element E starts lighting, it is possible to surely limit an electric current and prevent an excessive current from flowing.

A second embodiment is explained.

Figure 3:
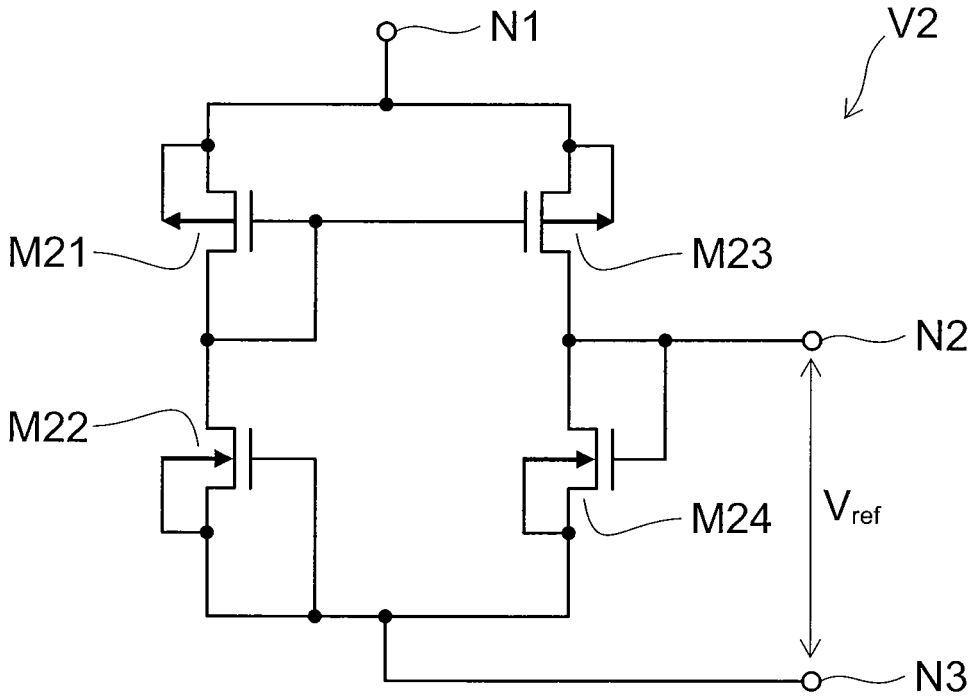
FIG. 3 is a circuit diagram of an example of a constant voltage circuit in a second embodiment.

FIG. 3 is a circuit diagram of an example of a constant voltage circuit in this embodiment.

As shown in FIG. 3, this embodiment is different from the first embodiment in the configuration of a constant voltage circuit. Specifically, in this embodiment, a constant voltage circuit V2 is provided instead of the constant voltage circuit V1 in the first embodiment. Components other than the constant voltage circuit of a luminaire according to this embodiment are the same as the components shown in FIG. 1.

As shown in FIG. 3, in the constant voltage circuit V2, p-channel MOS transistors (hereinafter, PMOSs) M21 and M23 and n-channel MOS transistors (hereinafter, NMOSs) M22 and M24 are provided. The NMOS M22 is a transistor of a normally on type. The NMOS M24 is a transistor of a normally off type. Sources of the PMOSs M21 and M23 are connected to the terminal N1 and gates of the PMOSs M21 and M23 are connected to a drain of the PMOS M21. The drain of the PMOS M21 is connected to a drain of the NMOS M22. A drain of the PMOS M23 is connected to a drain of the NMOS M24. Sources of the NMOSs M22 and M24 are connected to the terminal N3. A gate of the NMOS M22 is connected to the terminal N3. A gate of the NMOS M24 is connected to the terminal N2. The drain of the PMOS M23 and the drain of the NMOS M24 are also connected to the terminal N2.

The constant voltage circuit V2 can output, as the voltage $V_{ref}$ between the terminal N2 and the terminal N3, a voltage based on a difference between a threshold voltage $V_{th22}$ of the NMOS M22 of the normally on type and a threshold voltage $V_{th24}$ of the NMOS M24 of the normally off type. Specifically, when proportionality constants (gain coefficients) of an electric current to an overdrive voltage of the PMOSs M21 and M23 and NMOSs M22 and M24 are respectively represented as $\beta_{21}$, $\beta_{23}$, $\beta_{22}$, and $\beta_{24}$, the voltage $V_{ref}$ between the terminal N2 and the terminal N3 is given by Expression 2 below. At this point, temperature coefficients of the threshold voltages $V_{th22}$ and $V_{th24}$ cancel each other in first approxima tion. Therefore, temperature dependency of the voltage $V_{ref}$ is small and can take a substantially fixed value.

$$V_{ref} = V_{th24} - \left(\frac{\beta_{23}}{\beta_{21}}\right) \times V_{th22} \times \sqrt{\frac{\beta_{22}}{\beta_{24}}} \quad \text{Expression 2}$$

In this embodiment, the constant voltage circuit V2 can apply the constant voltage $V_{ref}$ specified by Expression 2 between the source and the gate of the constant current element Q2 and control the saturation current of the constant current element Q2 to a predetermined current value.

Components, operations, and effects in this embodiment other than those explained above are the same as the components, the operations, and the effects explained in the first embodiment.

Third embodiment is explained.

Figure 4:
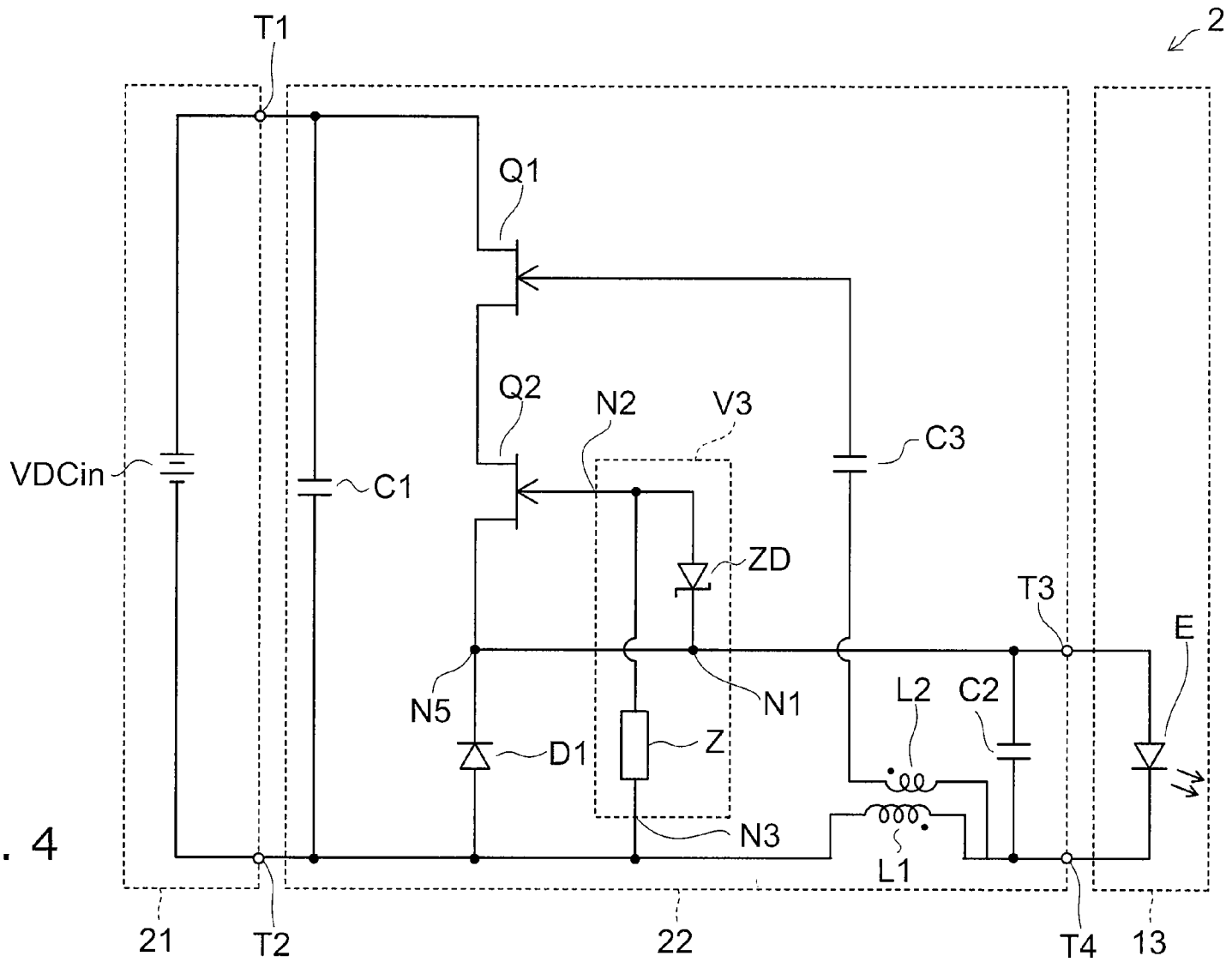
FIG. 4 is a circuit diagram of an example of a luminaire according to a third embodiment.

FIG. 4 is a circuit diagram of an example of a luminaire according to this embodiment.

As shown in FIG. 4, this embodiment is different from the first embodiment in the configurations of a direct-current power supply and the first inductor L1 and a constant voltage circuit V3 in a DC-DC converter. Specifically, in this embodiment, a direct-current power supply 21 is provided instead of the direct-current power supply 11 according to the embodiments explained above. The first inductor L1 connected between the connection point N5 of the DC-DC converter 12 and the output terminal T3 on the high-potential side in the first embodiment is connected between the output terminal T2 on the low-potential side and the output terminal T4 on the low-potential side. Further, the constant voltage circuit V3 is provided instead of the constant voltage circuit V1 of the DC-DC converter 12 in the first embodiment. Components other than the direct-current power supply 21, the position of the first inductor L1 of the DC-DC converter 22, and the constant voltage circuit V3 of a luminaire 2 according to this embodiment are the same as the components shown in FIG. 1.

The direct-current power supply 21 is, for example, a battery. The direct-current power supply 21 generates a direct-current voltage VDCin between the output terminal T1 and the output terminal T2 and supplies the direct-current voltage VDCin to the DC-DC converter 22.

In the DC-DC converter 22, the second inductor L2 is connected between the output terminal T4 on the low-potential side and one terminal of the coupling capacitor C3 and is magnetically coupled to the first inductor L1. In the second inductor L2, when an electric current flowing from the connection point N5 to the output terminal T3 through the first inductor L1 increases, an electromotive force for setting the coupling capacitor C3 to potential higher than the potential at the connection point N5 is generated. When the current decreases, an electromotive force for setting the coupling capacitor C3 to potential lower than the potential at the connection point N5 is generated. The other terminal of the coupling capacitor C3 is connected to the gate, which is the control terminal, of the switching element Q1. The diode D2 in the first embodiment is not provided. However, the diode D2 does not have to be provided as long as the switching element Q1 can be turned on or off according to the gate potential of the switching element Q1.

In the constant voltage circuit V3, a constant voltage diode ZD and an impedance element Z are provided. The constant voltage diode ZD is connected between the connection point N5 and the gate of the constant current element Q2 (the control terminal of the constant current element). The impedance element Z is connected between the gate of the constant current element Q2 and the output terminal T2 on the low-potential side of the direct-current power supply 21. Voltages at both ends of the smoothing capacitor C2 are applied to both ends of the constant voltage diode ZD and the impedance element Z, which are connected in series, via the first inductor L1. Therefore, both the ends of the constant voltage diode ZD have a constant voltage. The impedance element Z only has to capable of feeding a reverse current to the constant voltage diode ZD and generating a constant voltage. For example, the impedance element Z only has to feed an electric current of about several microamperes.

In this embodiment, as in the second embodiment, the constant voltage circuit V3 can apply the constant voltage at the both ends of the constant voltage diode ZD between the source and the gate of the constant current element Q2 and control the saturation current of the constant current element Q2 to a predetermined current value.

In this embodiment, the first inductor L1 is connected between the output terminal T2 on the low-potential side of the direct-current power supply 21 and the output terminal T4 on the low-potential side of the DC-DC converter 22. However, the operation of the DC-DC converter 22 is the same as the operation of the DC-DC converter 12 in the first embodiment. Components, operations, and effects in this embodiment other than those explained above are the same as the components, the operations, and the effects explained in the first embodiment.

A fourth embodiment is explained.

Figure 5:
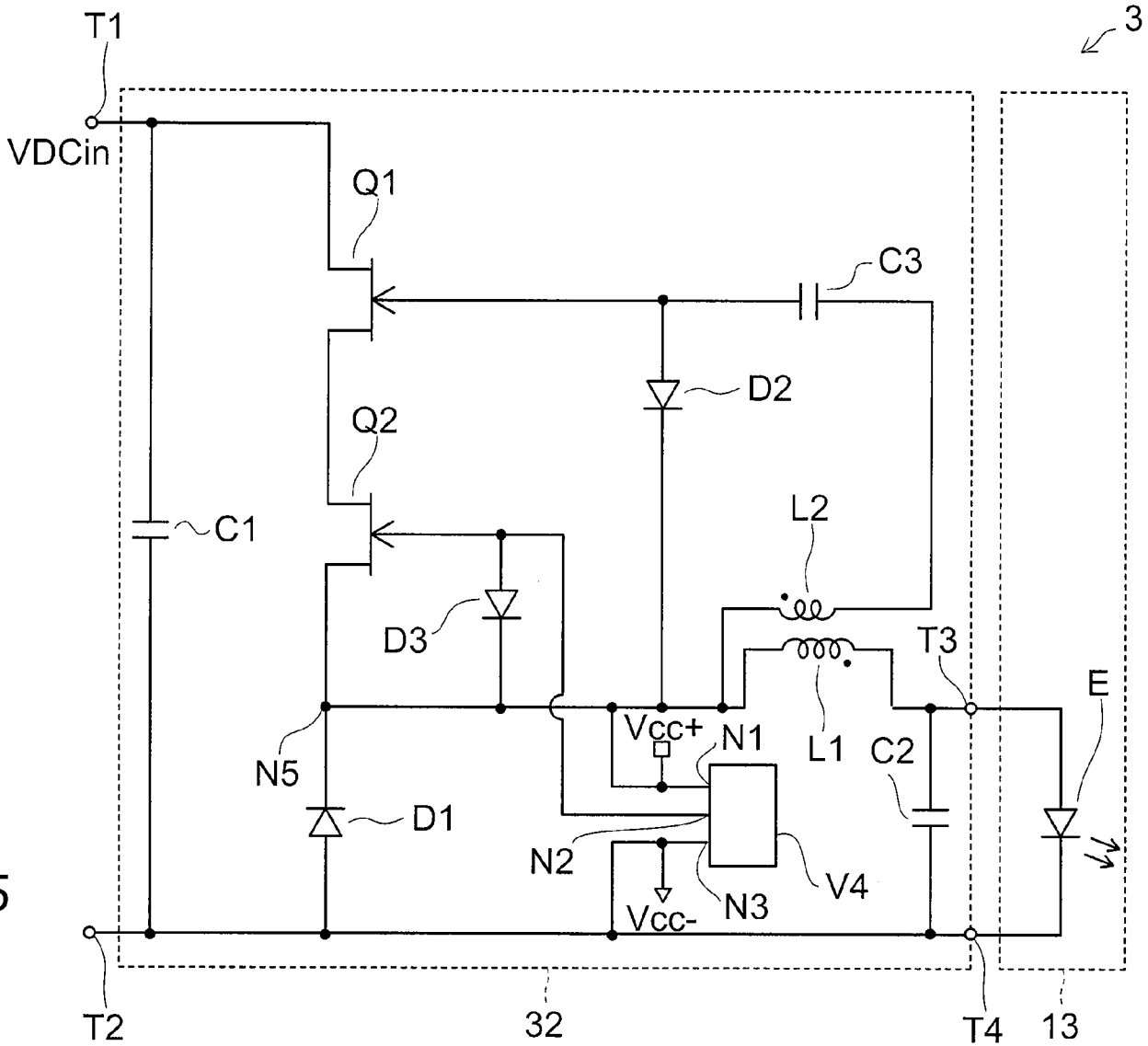
FIG. 5 is a circuit diagram of an example of a luminaire according to a fourth embodiment.

FIG. 5 is a circuit diagram of an example of a luminaire according to this embodiment.

As shown in FIG. 5, this embodiment is different from the first embodiment in that a direct-current power supply is not provided and in the configuration of a constant voltage circuit V4 in a DC-DC converter 32. Specifically, in this embodiment, the direct-current power supplies 11 and 21 in the first and second embodiments are not provided. The direct-current power-supply voltage VDCin is supplied from the outside. The constant voltage circuit V4 is provided instead of the constant voltage circuit V1 of the DC-DC converter 12 in the first embodiment. Components other than the constant voltage circuit V4 of the DC-DC converter 32 of a luminaire 3 according to this embodiment are the same as the components shown in FIG. 1.

The terminal N1 of the constant voltage circuit V4 is connected to the connection point N5. The terminal N2 of the constant voltage circuit V4 is connected to the gate of the constant current element Q2 (the control terminal of the constant current element). The terminal N3 of the constant voltage circuit V4 is connected to the output terminal T2. The constant voltage circuit V4 is a circuit that receives the supply of high potential VCC+ from the terminal N1, receives the supply of low potential VCC− from the terminal N3, and outputs intermediate potential, which can be adjusted between the high potential VCC+ and the low potential VCC−, from the terminal N2. A voltage between the terminal N1 and the terminal N2 can be adjusted. A gate-to-source voltage of the constant current element Q2 (the control voltage of the constant current element) is an adjustable negative fixed value. The high potential VCC+ and the low potential VCC− supplied to the constant voltage circuit V4 are voltages at both the ends of the smoothing capacitor C2 supplied via the first inductor L1. The voltages at both the ends of the smoothing capacitor C2 change to a forward voltage of the LED element E when the LED element E is lit. Therefore, it is possible to cause the constant voltage circuit V4 to operate. A diode D3 is connected between the gate and the source of the constant current element Q2 in order to protect the gate of the constant current element Q2.

In this embodiment, when the LED element E is lit, the constant voltage circuit V4 can apply the adjustable negative constant voltage between the gate and the source of the constant current element Q2 and control the saturation current of the constant current element Q2 to a predetermined current value. Therefore, it is possible to adjust an average of electric currents flowing through the LED element E and adjust the luminance of the LED element E.

Components, operations, and effects in this embodiment other than those explained above are the same as the components, the operations, and the effects explained in the first embodiment.

A fifth embodiment is explained.

Figure 6:
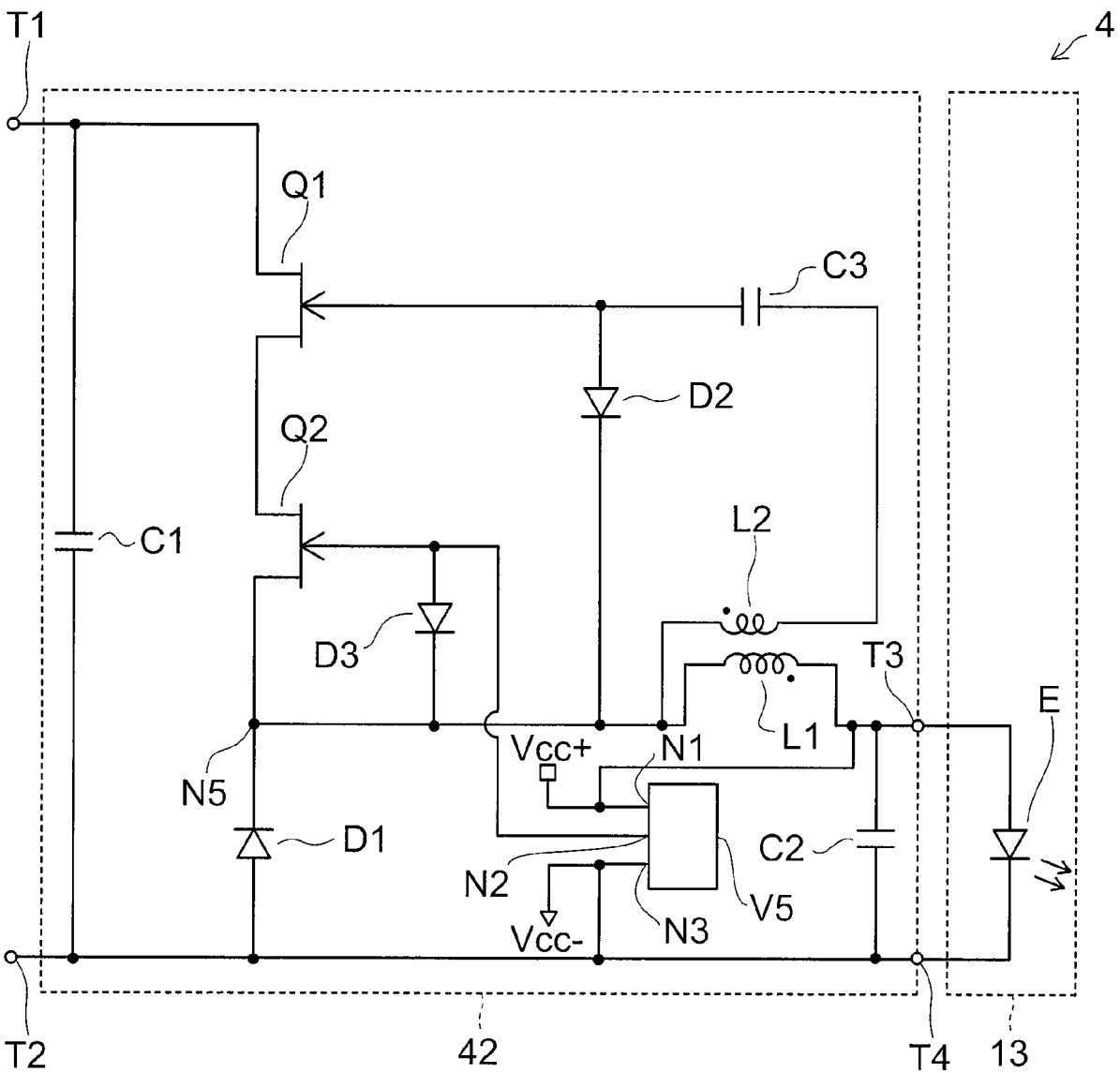
FIG. 6 is a circuit diagram of an example of a luminaire according to a fifth embodiment.

FIG. 6 is a circuit diagram of an example of a luminaire according to this embodiment.

As shown in FIG. 6, this embodiment is different from the fourth embodiment in the configuration of a constant voltage circuit V5 in a DC-DC converter. Specifically, in this embodiment, the constant voltage circuit V5 is provided instead of the constant voltage circuit V4 of the DC-DC converter 32 in the fourth embodiment. Components other than the constant voltage circuit V5 of a DC-DC converter 42 of a luminaire 4 according to this embodiment are the same as the components shown in FIG. 5.

The terminal N1 of the constant voltage circuit V5 is connected to the output terminal T3 on the high-potential side. The terminal N2 of the constant voltage circuit V5 is connected to the gate of the constant current element Q2. The terminal N3 of the constant voltage circuit V5 is connected to the output terminal T4 on the low-potential side. The constant voltage circuit V5 is a circuit that receives the supply of high potential VCC+ from the terminal N1, receives the supply of low potential VCC− from the terminal N3, and outputs intermediate potential, which can be adjusted between the high potential VCC+ and the low potential VCC−, from the terminal N2. A voltage between the terminal N2 and the terminal N3 can be adjusted. A gate-to-source voltage of the constant current element Q2 is an adjustable negative fixed value. The high potential VCC+ and the low potential VCC− supplied to the constant voltage circuit V5 are voltages at both the ends of the smoothing capacitor C2. The voltages at both the ends of the smoothing capacitor C2 change to a forward voltage of the LED element E when the LED element E is lit. Therefore, it is possible to cause the constant voltage circuit V5 to operate.

In this embodiment, when the LED element E is lit, the constant voltage circuit V5 can apply the adjustable negative constant voltage between the gate and the source of the constant current element Q2 and control the saturation current of the constant current element Q2 to a predetermined current value. Therefore, it is possible to adjust an average of electric currents flowing through the LED element E and adjust the luminance of the LED element E.

Components, operations, and effects in this embodiment other than those explained above are the same as the components, the operations, and the effects explained in the first embodiment.

The present invention is explained above with reference to the embodiments. However, the scope of the present invention is not limited to the embodiments explained above. Appropriate additions, changes, and omissions of components by those skilled in the art are included in the present invention without departing from the spirit of the present invention.

For example, in the example explained in the first to fifth embodiments, the switching element Q1 is the element of the normally on type. However, the present invention is not limited to this example. The switching element Q1 may be an element of the normally off type. In this case, the direction of the diode D2 is reversed. Specifically, the anode of the diode D2 is connected to the connection point N5 and the cathode of the diode D2 is connected to the coupling capacitor C3 and the gate of the switching element Q1. The diode D2 clamps a voltage between the gate of the switching element Q1 and the source of the constant current element Q2 to a voltage equal to or lower than a forward voltage. The gate potential of the switching element Q1 is level-shifted to a positive potential side. The switching element Q1 of the normally off type can be surely turned on and off.

In the example explained in the first and second embodiments, the constant current element Q2 is the element of the normally on type. However, the present invention is not limited to this example. The constant current element Q2 may be an element of the normally off type. In this case, the connection of the terminal N2 and the terminal N3 in the constant voltage circuit V1 or V2 is reversed. Specifically, the relatively high-potential terminal N2 is connected to the gate of a switching element Q2. The relatively low-potential terminal N3 is connected to the source of the switching element Q2, i.e., the connection point N5. The gate-to-source voltage of the constant current element Q2 is a positive fixed value.

The configuration of the DC-DC converter is not limited to the configuration shown in FIGS. 1 and 2. The DC-DC converter is not limited to a voltage falling type and may be, for example, a rising voltage type or a rising-falling type. The switching power-supply device may be only the DC-DC converter.

The switching element Q1 and the constant current element Q2 are not limited to the GaN HEMTs. For example, the switching element Q1 and the constant current element Q2 may be semiconductor elements formed using a semiconductor having a wide band gap such as silicon carbide (SiC), gallium nitride (GaN), or diamond (a wide band gap semiconductor) on a semiconductor substrate. The wide band gap semiconductor means a semiconductor, a band gap of which is wider than a band gap of gallium arsenide (GaAs) of about 1.4 eV. Examples of the wide band gap semiconductor include a semiconductor, a band gap of which is equal to or larger than 1.5 eV, gallium phosphide (GaP, a band gap is about 2.3 eV), gallium nitride (GaN, a band gap is about 3.4 eV), diamond (C, a band gap is about 5.27 eV), aluminum nitride (AlN, a band gap is about 5.9 eV), and silicon carbide (SiC). In such a wide band gap semiconductor, parasitic capacitance can be reduced. As a result, since high-speed operation is possible, the switching power-supply device can be further reduced in size.

Further, the configuration of the constant voltage circuit is not limited to the configuration shown in FIGS. 2 and 3. The constant voltage circuit only has to be a circuit that can supply a constant voltage. Furthermore, the illumination light source E is not limited to the LED and may be an EL or an OLED. Plural illumination light sources E may be connected to the lighting load 13 in series or in parallel.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes may be made without departing from the spirit of the inventions. These embodiments and modifications thereof are included in the scope and the spirit of the invention and included in the inventions described in the claims and the scope of equivalents of the inventions.

What is claimed is:

1. A switching power-supply device comprising:

a first inductor;

a switching element configured to supply, when the switching element is on, a power-supply voltage of a direct-current power supply to and feed an electric current to the first inductor;

a constant current element connected to the switching element in series and configured to turn off the switching element when the electric current of the switching element exceeds a predetermined current value;

a rectifying element connected to any one of the switching element and the constant current element in series and configured to feed the electric current of the first inductor when the switching element is turned off;

a second inductor magnetically coupled to the first inductor and configured to have induced therein potential for turning on the switching element when the electric current of the first inductor increases and have induced therein potential for turning off the switching element when the electric current of the first inductor decreases and supply the induced potential to a control terminal of the switching element; and a constant voltage circuit configured to apply control potential to a control terminal of the constant current element.

2. The device according to claim 1, wherein the constant current element is a transistor of a normally on type, and the constant voltage circuit applies potential lower than potential of a source of the constant current element to a gate of the constant current element.

3. The device according to claim 1, wherein the constant voltage circuit outputs a constant voltage based on a base-to-emitter voltage of a bipolar transistor.

4. The device according to claim 1, wherein the constant voltage circuit outputs the constant voltage based on a difference between a threshold voltage of a transistor of a normally on type and a threshold voltage of a transistor of a normally off type.

5. The device according to claim 1, wherein the constant voltage circuit operates at a power-supply voltage of the direct-current power supply.

6. The device according to claim 1, further comprising a smoothing capacitor provided on an output side, wherein the constant voltage circuit receives supply of voltages at both ends of the smoothing capacitor and operates.

7. The device according to claim 1, wherein the constant current element includes at least a first terminal and a second terminal, the first terminal of the constant current element being connected to the switching element, the constant voltage circuit includes:

a Zener diode connected between the second terminal of the constant current element and the control terminal of the constant current element; and an impedance element connected between the control terminal of the constant current element and a place where potential is lower than potential of the control terminal of the constant current element, and the constant voltage circuit supplies negative potential to the control terminal of the constant current element.

8. A switching power-supply device comprising:

a switching element, a first terminal of which is connected to one terminal of a direct-current power supply;

a constant current element, a first terminal of which is connected to a second terminal of the switching element;

a first inductor, a first terminal of which is connected to a second terminal of the constant current element;

a second inductor magnetically coupled to the first inductor and configured to supply control potential for turning on the switching element to a control terminal of the switching element when an electric current flowing to the first inductor increases and supply control potential for turning off the switching element to the control terminal of the switching element when the electric current flowing to the first inductor decreases;

a rectifying element connected between the other terminal of the direct-current power supply and a first terminal of the first inductor and configured to feed an electric current in a direction in which an electric current in a same direction as the electric current supplied to the first inductor is supplied to the first inductor via the switching element and the constant current element; and a constant voltage circuit configured to apply a control voltage between a second terminal and a control terminal of the constant current element.

9. The device according to claim 8, wherein the constant current element is a transistor of a normally on type, and the constant voltage circuit applies potential lower than potential of a source of the constant current element to a gate of the constant current element.

10. The device according to claim 8, wherein the constant voltage circuit outputs a constant voltage based on a base-to-emitter voltage of a bipolar transistor.

11. The device according to claim 8, wherein the constant voltage circuit outputs the constant voltage based on a difference between a threshold voltage of a transistor of a normally on type and a threshold voltage of a transistor of a normally off type.

12. The device according to claim 8, wherein the constant voltage circuit operates at a power-supply voltage of the direct-current power supply.

13. The device according to claim 8, further comprising a smoothing capacitor provided on an output side, wherein the constant voltage circuit receives supply of voltages at both ends of the smoothing capacitor and operates.

14. The device according to claim 8, wherein the constant voltage circuit includes:

a Zener diode connected between the second terminal of the constant current element and the control terminal of the constant current element; and an impedance element connected between the control terminal of the constant current element and a place where potential is lower than potential of the control terminal of the constant current element, and the constant voltage circuit supplies negative potential to the control terminal of the constant current element.

15. A luminaire comprises:

a switching power-supply devices; and a lighting load connected between output terminals of the switching power-supply device, wherein the switching power-supply device includes:

a first inductor;

a switching element configured to supply, when the switching element is on, a power-supply voltage of a direct-current power supply to and feed an electric current to the first inductor;

a constant current element connected to the switching element in series and configured to turn off the switching element when the electric current of the switching element exceeds a predetermined current value;

a rectifying element connected to any one of the switching element and the constant current element in series and configured to feed the electric current of the first inductor when the switching element is turned off;

a second inductor magnetically coupled to the first inductor and configured to have induced therein potential for turning on the switching element when the electric current of the first inductor increases and have induced therein potential for turning off the switching element when the electric current of the first inductor decreases and supply the induced potential to a control terminal of the switching element; and a constant voltage circuit configured to apply control potential to a control terminal of the constant current element.

16. The luminaire according to claim 15, wherein the constant current element is a transistor of a normally on type, and the constant voltage circuit applies potential lower than potential of a source of the constant current element to a gate of the constant current element.

17. The luminaire according to claim 15, wherein the constant voltage circuit outputs a constant voltage based on a base-to-emitter voltage of a bipolar transistor.

18. The luminaire according to claim 15, wherein the constant voltage circuit outputs the constant voltage based on a difference between a threshold voltage of a transistor of a normally on type and a threshold voltage of a transistor of a normally off type.

19. The luminaire according to claim 15, wherein the constant voltage circuit operates at a power-supply voltage of the direct-current power supply.

20. The luminaire according to claim 15, wherein the switching power-supply device further includes a smoothing capacitor provided on an output side, and the constant voltage circuit receives supply of voltages at both ends of the smoothing capacitor and operates.

* * * * *